United States Patent [19]

Bauder

[11] Patent Number: 4,748,371

[45] Date of Patent: May 31, 1988

[54] CATHODE-RAY TUBE SHADOW MASK FOR LOW OVERSCAN

[75] Inventor: Richard C. Bauder, Millersville, Pa.

[73] Assignee: RCA Licensing Corporation, Princeton, N.J.

[21] Appl. No.: 13,090

[22] Filed: Feb. 10, 1987

[51] Int. Cl.[4] ..... H01J 29/07

[52] U.S. Cl. ..... 313/407; 313/403

[58] Field of Search ..... 313/407, 403, 408, 402

[56] References Cited

U.S. PATENT DOCUMENTS

| | | | |
|---|---|---|---|
| 3,030,536 | 4/1962 | Hacket et al. | 313/402 X |
| 4,196,446 | 4/1980 | Rowe et al. | 358/74 |
| 4,286,189 | 8/1981 | Koizumi et al. | 313/407 X |
| 4,599,533 | 7/1986 | Ragland, Jr. | 313/407 |
| 4,659,957 | 4/1987 | Nill | 313/402 |

FOREIGN PATENT DOCUMENTS

| | | | |
|---|---|---|---|
| 0071257 | 6/1981 | Japan | 313/408 |
| 0130032 | 7/1985 | Japan | 313/407 |

*Primary Examiner*—Palmer C. DeMeo

*Attorney, Agent, or Firm*—E. M. Whitacre; D. H. Irlbeck; T. H. Magee

[57] ABSTRACT

A cathode-ray tube includes a shadow mask having an array of apertures mounted adjacent a substantially rectangular faceplate panel with curvature along major and minor axes orthogonal to each other and to a central longitudinal axis passing through the center of the faceplate panel. The shadow mask has a border of varying width disposed between the perimeter of the apertured array and a bend line adjoining a peripheral mask skirt which substantially parallels the central axis and is supported by a shadow-mask frame oriented orthogonally to the central axis. The width of the border is narrow at the major axis, being no greater than five percent of the distance from the minor axis to the bend line along the major axis.

8 Claims, 2 Drawing Sheets

CATHODE-RAY TUBE SHADOW MASK FOR LOW OVERSCAN

BACKGROUND OF THE INVENTION

This invention pertains to a cathode-ray tube including a shadow mask having an array of apertures surrounded by a nonapertured border.

In manufacturing a cathode-ray tube for use in color television, a panel assembly is formed which includes a shadow mask having an array of apertures mounted adjacent a substantially rectangular faceplate panel with major and minor axes orthogonal to each other and to a central longitudinal axis passing through the center of the panel. The faceplate panel is made of glass and has a somewhat spherical or domed contour with curvature along both the major and minor axes. The apertures in the shadow mask are typically slit-shaped and arranged in columns that substantially parallel the minor axis of the tube, and the adjacent apertures in each column are separated from each other by bridges or webs in the mask. The apertures are formed typically by etching utilizing photolithographic techniques. The overall shape of the apertured array determines the shape of the picture on the faceplate panel of the tube.

The shadow mask has a nonapertured border comprising an unetched portion which surrounds the etched array of apertures. The border is disposed between the perimeter of the apertured array and a bend, line adjoining a mask skirt. The skirt substantially parallels the central axis and is supported by a shadow-mask frame oriented orthogonally to the central axis. The frame is supported by springs that engage mounting studs that extend inwardly from glass sides of the faceplate panel. The overall shape of the frame, and the bend line of the supported mask, is similar to that of the glass sides of the faceplate panel.

The color cathode-ray tube employs three electron guns for emitting three electron beams which pass through a common deflection yoke, with one beam for each primary phosphor color,.i.e., red, green and blue. The beams are "shadowed" by the apertured mask, so that each beam can strike but one color of a segmented catholuminescent screen of red, green and blue phosphors disposed close to the mask on the inside surface of the faceplate panel. At the point where the electrons from one of the guns impinge on the screen, one of the color phosphors is deposited in a line that approximates the size of the mask aperture. All other parts of the phosphor screen are in the "shadow" of the phosphor mask, as far as this one gun is concerned. Thus, the position and size of the apertures in the shadow mask are important ultimately to achieve good color purity. The rectangular area scanned by the electron beams as they are deflected horizontally and vertically is called the raster. The percentage of the raster which exceeds the perimeter of the apertured array in the shadow mask, along the major axis, is known as overscan. The greater the overscan, the more picture information that is lost due to a greater percentage of the raster being lost by falling outside of the apertured array.

During initial operation of the cathode-ray tube, the shadow mask is heated due to the impingement of the electron beams upon the mask, which absorbs as much as eighty percent of the energy of the beams. The shadow mask is made of relatively thin metal which heats more rapidly than the thicker support frame which serves as a heat sink, thereby resulting in a temperature differential which causes the mask to expand at a greater rate than the frame. Since the shadow mask is peripherally welded to the frame, this more rapid expansion of the shadow mask is resisted by the frame, thereby resulting in mask doming. Such mask doming causes the electron beams, passing therethrough, to misregister with the associated phosphor elements of the screen, resulting in color impurities. This movement can be largely compensated for by the use of temperature-responsive frame supports which cause the mask-frame assembly to move toward the screen in response to the temperature increases in the mask, thereby restoring registration.

Another effect of mask heating, and one that can not be compensated for by temperature-responsive frame supports, is expansion of the mask under certain conditions wherein temperature gradients exist within the mask itself, thereby causing the mask to dome. Such doming causes mask misregistration and variations in misregistration to occur at relatively low overscan, typically three to five percent of total scan. Since more picture information is available at low overscan conditions, it is desirable to be able to minimize doming misregister and variations in doming misregister while operating the cathode-ray tube at relatively low overscan.

SUMMARY OF THE INVENTION

The present invention comprises a cathode-ray tube which includes a shadow mask having an array of apertures mounted adjacent a substantially rectangular faceplate panel with curvature along major and minor axes orthogonal to each other and to a central longitudinal axis passing through the center of the faceplate panel. The shadow mask has a border of varying width disposed between the perimeter of the apertured array and a bend line adjoining a peripheral mask skirt which substantially parallels the central axis and is supported by a shadow-mask frame oriented orthogonally to the central axis. The width of the border is narrow at the major axis, being no greater than five percent of the distance from the minor axis to the bend line along the major axis.

DETAILED DESCRIPTION OF THE PREFERRED EMBODIMENT

Figure 1:
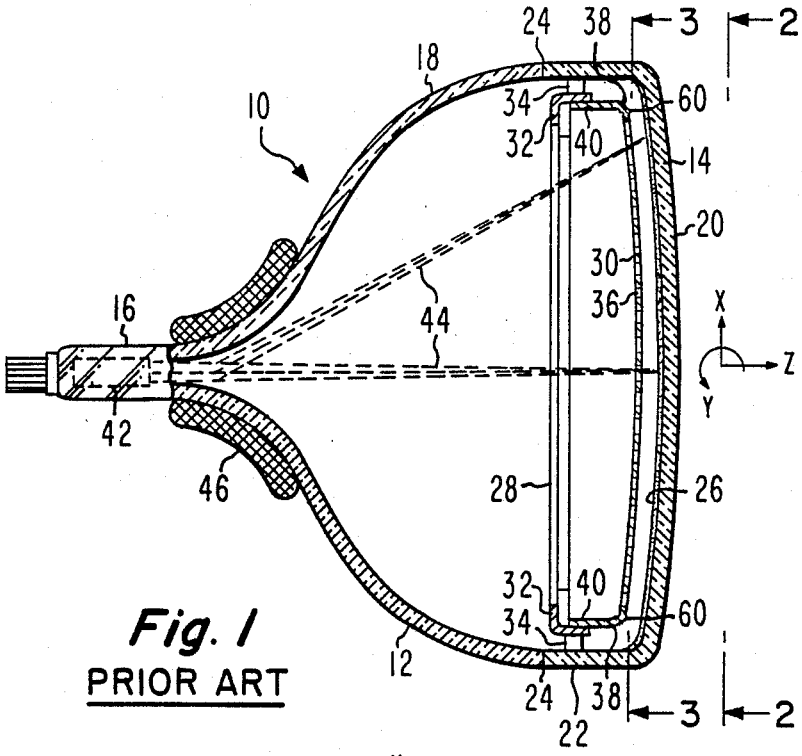
Fig. 1 PRIOR ART
FIG. 1 is a plan view, partly in axial section, of a prior-art cathode-ray tube having a shadow mask adjacent a faceplate panel.

FIG. 1 shows a prior-art cathode-ray tube 10 having a glass envelope 12 comprising a substantially rectangular faceplate panel 14 and a tubular neck 16 connected by a funnel 18. The panel 14 comprises a viewing faceplate 20 and a peripheral flange or sidewall 22, which is sealed to the funnel 18 by a glass frit 24. The faceplate 20 is curved along both major and minor axes, X and Y, orthogonal to each other and to a central axis, Z, passing through the center of the faceplate 20. A rectangular three-color cathodoluminescent phosphor screen 26 is disposed on the inner surface of the faceplate 20. The screen 26 is preferably a line screen, with the phosphor lines extending substantially parallel to the minor axis, Y, of the cathode-ray tube 10 (normal to the plane of FIG. 1). A mask-frame assembly 28, comprising a color-selection electrode or shadow mask 30 attached to an L-shaped frame 32, is removably mounted within the faceplate panel 14 in predetermined spaced relation to the screen 26 by springs 34. The shadow mask 30 includes a plurality of slit-shaped apertures 36, and has a peripheral bend line 38 adjoining a mask skirt 40 which substantially parallels the central axis (Z) and is attached to the inside of the frame 32. An inline electron gun 42, shown schematically by dashed lines in FIG. 1, is centrally mounted within the neck 16 to generate and direct three electron beams 44 along initially coplanar convergent paths through the apertures 36 in the shadow mask 28 to the screen 26.

The cathode-ray tube 10 of FIG. 1 is designed to be used with an external magnetic deflection yoke, such as the yoke 46 schematically shown surrounding the neck 16 and funnel 18 in the neighborhood of their junction, for subjecting the three beams 34 to vertical and horizontal magnetic flux, to scan the beams 34 horizontally in the direction of the major axis (X) and vertically in the direction of the minor axis (Y), respectively, in a rectangular raster over the screen 26.

Figure 2:
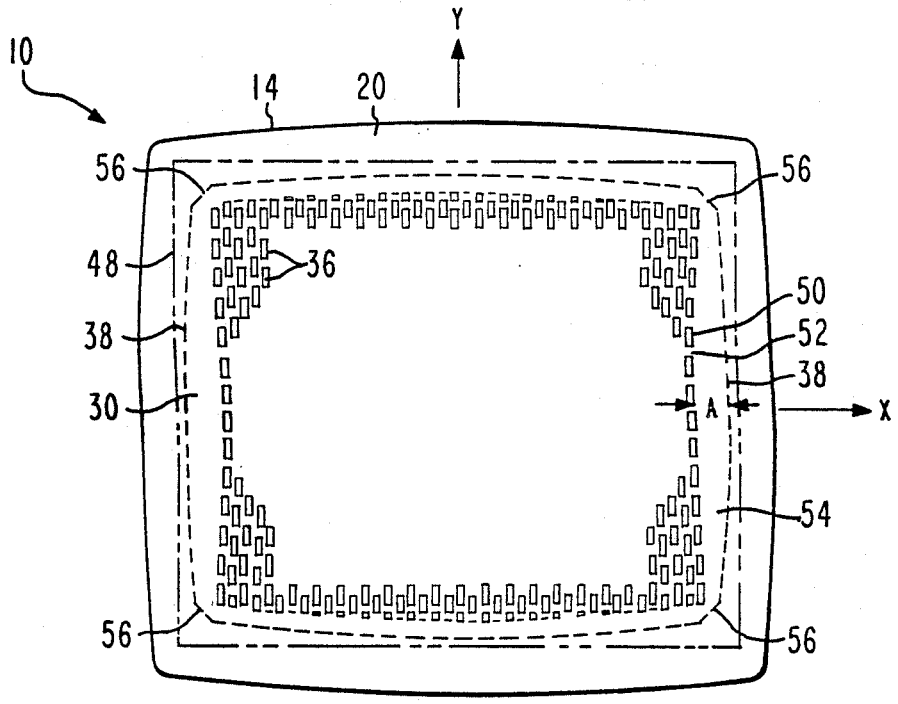
Fig. 2 PRIOR ART
FIG. 2 is a front view of the faceplate panel taken along line 2—2 of FIG. 1.

FIG. 2 shows the front of the faceplate panel 14 of the cathode-ray tube 10. The periphery of the panel 14 is substantially rectangular, with slightly outwardly curved sides. The edge of the screen 26 is rectangular, and is shown by dashed line 48 in FIG. 2. The slit-shaped apertures 36 in the shadow mask 30 are aligned in substantially parallel columns with web portions separating the slits within each column, so as to form an array 50 having a defined perimeter 52, as shown in FIG. 2. The overall shape of the apertured array 50 determines the shape of the picture on the faceplate 20 of the cathode-ray tube 10. In order to achieve a rectangular picture or screen 26 on the faceplate 20, typically the perimeter 52 of the apertured array 50 extending along the direction of the major axis (X) is curved slightly outward, and the perimeter 52 extending along the direction of the minor axis (Y) is curved slightly inward to form a "pinned" shape, as shown in FIG. 2.

The shadow mask 30 has a nonapertured border 54 comprising an unetched portion which surrounds the etched array 50 of apertures 36. The border 54 is disposed between the perimeter 52 of the apertured array 50 and the bend line 38 adjoining the mask skirt 40. Since the overall shape of the shadow-mask frame 32 is similar to that of the sidewall 22 of the faceplate panel 14, the bend line 38 in the shadow mask 30 is also slightly curved outwardly. Consequently, the border 54 is relatively wide at the major axis, as shown by distance A in FIG. 2. Also, the shadow mask 30 and frame 32 have truncated corners 56, as disclosed in U.S. Pat. No. 4,599,533, issued to F. R. Ragland, Jr. on July 8, 1986.

Figure 3:
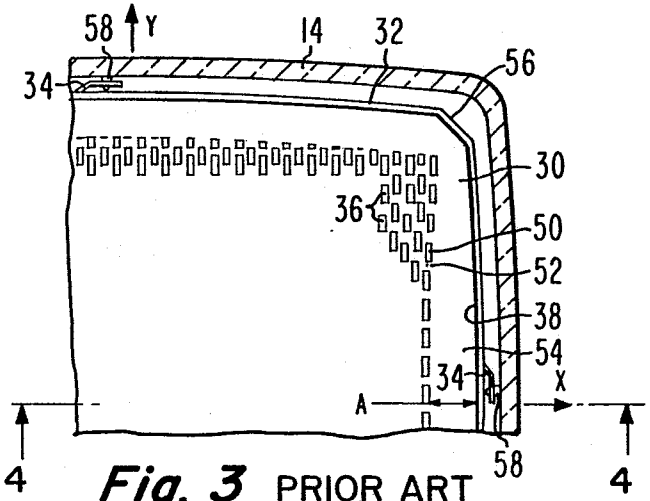
Fig. 3 PRIOR ART
FIG. 3 is a partial cross-sectional view taken along line 3—3 of FIG. 1.
Figure 4:
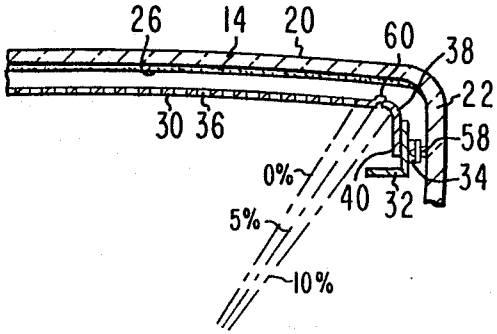
Fig. 4 PRIOR ART
FIG. 4 is a partial cross-sectional view taken along line 4—4 of FIG. 3.

FIGS. 3 and 4 illustrate the effect of different overscan conditions on the prior-art cathode-ray tube 10. The shadow-mask frame 32, which is oriented orthogonally to the central axis (Z), is supported adjacent the sidewall 22 by mounting studs 58 which extend inwardly from the sidewall 22 and engage the springs 34. The shadow mask 30 is typically made of 0.15 mm thick steel, and may be welded to the inside of the frame 32, as shown in FIGS. 3 and 4, to form a MIFA (Mask Inside Frame Assembly). FIG. 4 shows the electron beams 44 impinging on the shadow mask 30 at zero percent overscan, at five percent overscan, and at ten percent overscan. At zero percent overscan, the edge of the raster, or the area scanned by the electron beams 44, coincides with the perimeter 52 of the apertured array 50 at the major axis (X). At five percent overscan, the edge of the raster impinges on the shadow mask 30 in the vicinity of a perimeter bead 60 disposed near the bend line 38 of the mask 30. At ten percent overscan, the edge of the raster roughly coincides with the bend line 38 at the major axis (X), as shown in FIG. 4.

It is hypothesized that at relatively low overscan conditions, typically three to five percent of total scan, the prior-art design of FIGS. 3 and 4 permits a "cold ring" to form initially between the bend line 38 and the vicinity of the bead 60. Since the heat loss from that portion of the border 54 heated by the impinging electron beams 44 is primarily by radiation, it takes a relatively longer period of time for this peripheral "cold ring" to be heated by conduction. The resulting temperature differential in the border 54 creates a reaction force in the plane of the shadow mask 30 which causes excessive doming prior to the long-term heating of the "cold ring" portion of the border 54.

Figure 5:
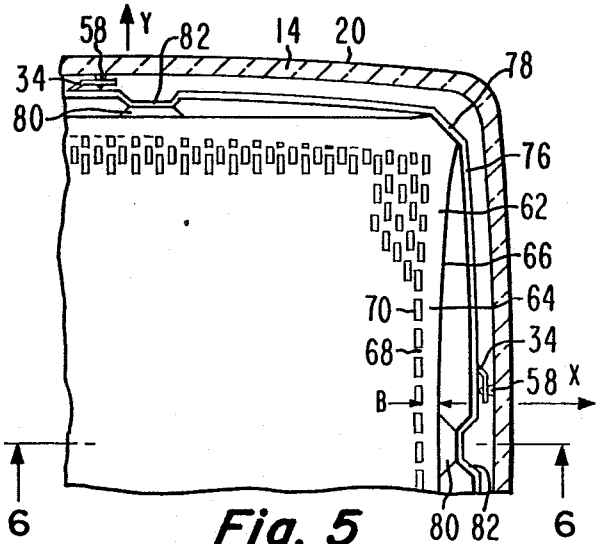
FIG. 5 is a partial cross-sectional view of a cathode-ray tube, similar to that of FIG. 3, incorporating one embodiment of the present invention.
Figure 6:
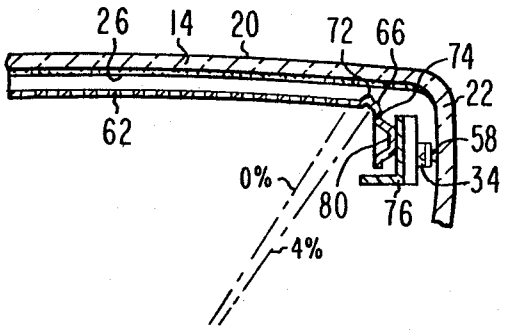
FIG. 6 is a partial cross-sectional view taken along line 6—6 of FIG. 5.

FIGS. 5 and 6 show one embodiment of a shadow mask 62 having a border 64 which minimizes this undesirable temperature differential in the border 64 at low overscan. It was determined that the width of the unetched border 64 was crucial to the amount of doming misregister and its dependence upon beam overscan variations. In particular, it has been discovered that the width of the border 64 should be relatively narrow at the major axis (X), being no greater than five percent of the distance from the minor axis (Y) to the bend line 66 along the major axis (X). Preferably, the width of the border 64, as shown by distance B in FIG. 5, is narrowest at the major axis (X). Ideally, the unetched border 64 disposed between the perimeter 68 of the apertured array 70 and the bend line 66, is shaped so as to allow the border 64 to be completely scanned by the raster at low overscan conditions (typically three to five percent of total scan), thereby more uniformly heating the periphery of the mask 62 and reducing doming misregister. As shown in FIG. 6, the edge of the raster, at four percent overscan, is just beyond the bead 72 and roughly coincides with the bend line 66 at the major axis (X). For a 26V/110 picture tube, the distance B is approximately 0.4 inch (10.2 mm), while the distance from the minor axis (Y) to the bend line 66, along the major axis (X), is approximately 9.9 inches (251 mm).

Since the perimeter 68 of the apertured array 70, which determines the shape of the picture on the screen, does not change, the shape of the bend line 66 is now determined by the perimeter 68 of the apertured array 70, rather than the frame/glass interface. In other words, the bend line 66 and mask skirt 74 are physically disposed inwardly away from the frame 76, except at the truncated corners 78 of the frame 76. Consequently, if the border 64 is to be completely scanned by the raster at low overscan conditions, the width of the border 64 is determined by the shape of the overscanned raster, the most critical location being where the edge of the raster intersects the major axis (X).

Implementation of this design for the shadow mask 62 requires the use of mask-to-frame supports which allow the shape of the mask 62 to deviate appreciably from the shape of the frame 76. In the present embodiment, the peripheral mask skirt 74 has a plurality of outwardly projecting weld pockets 80 attached, respectively, to a plurality of weld flutes 82 projecting inwardly from the shadow-mask frame 76, as shown in FIGS. 5 and 6. Also, in the present embodiment where the perimeter 68 of the etched array 70, extending along the direction of the minor axis (X), is curved slightly inward to form a "pinned" shape, the segments of the bend line 66 which intersect the major axis (X) curve inwardly toward the central axis (Z), as shown in FIG. 5. In this embodiment, it is necessary that the bend line 66 also have this "pinned" shape in order to reduce the width of the unetched border 64 between the perimeter 68 of the apertured array 70 and the bend line 66.

The present shadow mask 62 achieves improvements in doming misregister performance at low overscan, and the dependence of doming misregister upon beam overscan variations is reduced. The purpose of having a relatively narrow border 64 at the major axis (X) is to minimize the temperature gradient from the center to the edge of the mask 62, and to maintain an unchanging temperature gradient for a range of overscan conditions, i.e., for typical beam overscan variations during tube operation. As a result, the relatively narrow border 64 minimizes doming misregister at low overscan, and provides a shadow mask 62 which is less sensitive to overscan variations.

It should be understood that although the preferred embodiment has been shown with respect to a slit-type shadow mask, the present invention may also be applied to cathode-ray tubes having other types of masks, including those having circular apertures as well as to masks attached to the outsides of their respective frames. Furthermore, the invention may be applied to tubes having differently contoured shadow masks, including those with spherical, biradial and more complex curvatures.

What is claimed is:

1. In a cathode-ray tube including a shadow mask having an array of apertures mounted adjacent a substantially rectangular faceplate panel with curvature along major and minor axes orthogonal to each other and to a central longitudinal axis passing through the center of said faceplate panel, said shadow mask having a border of varying width disposed between the perimeter of said apertured array and a bend line adjoining a peripheral mask skirt, said skirt substantially paralleling said central axis and supported by a shadow-mask frame oriented orthogonally to said central axis, the improvement comprising:

the width of said border being narrowest at said major axis.

2. A cathode-ray tube as defined in claim 1 wherein said peripheral mask skirt has a plurality of outwardly projecting weld pockets attached, respectively, to a plurality of weld flutes projecting inwardly from said shadow-mask frame.

3. A cathode-ray tube as defined in claim 1 wherein said bend line has segments intersecting said major axis which curve inwardly toward said central axis.

4. A cathode-ray tube as defined in claim 1 wherein said shadow mask has truncated corners.

5. In a cathode-ray tube including a shadow mask having an array of apertures mounted adjacent a substantially rectangular faceplate panel with curvature along major and minor axes orthogonal to each other and to a central longitudinal axis passing through the center of said faceplate panel, said shadow mask having a border disposed between the perimeter of said apertured array and a bend line adjoining a peripheral mask skirt, said skirt substantially paralleling said central axis and supported by a shadow-mask frame oriented orthogonally to said central axis, the improvement comprising:

the width of said border at said major axis being no greater than five percent of the distance from said minor axis, to the bend line along said major axis.

6. A cathode-ray tube as defined in claim 5 wherein said peripheral mask skirt has a plurality of outwardly projecting weld pockets attached, respectively, to a plurality of weld flutes projecting inwardly form said shadow-mask frame.

7. A cathode-ray tube as defined in claim 5 wherein said bend line has segments intersecting said major axis which curve inwardly toward said central axis.

8. A cathode-ray tube as defined in claim 5 wherein said shadow mask has truncated corners.

* * * * *